United States Patent [19]

Guttman

[11] 4,161,333

[45] Jul. 17, 1979

[54] PROTECTIVE MEANS AGAINST UNAUTHORIZED ENTRY FOR A DOORWAY

[76] Inventor: Milton Guttman, 1719 Miami Gardens Dr., North Miami Beach, Fla. 33162

[21] Appl. No.: 872,829

[22] Filed: Jan. 27, 1978

Related U.S. Application Data

[63] Continuation-in-part of Ser. No. 663,129, Mar. 2, 1976, abandoned.

[51] Int. Cl.[2] ..... E05C 19/18; E05C 1/04

[52] U.S. Cl. ..... 292/288; 292/150

[58] Field of Search ..... 292/145, 288, 42, 184, 292/189, 264, 150; 16/137

[56] References Cited

U.S. PATENT DOCUMENTS

| | | | |
|---|---|---|---|
| 708,892 | 9/1902 | Long | 292/150 |
| 1,485,301 | 2/1924 | Sebastian | 292/189 |
| 1,517,447 | 12/1924 | Merz | 292/145 |
| 4,057,873 | 11/1977 | Bursani | 16/137 |
| 4,073,525 | 2/1978 | Gurule | 292/150 |

OTHER PUBLICATIONS

Popular Mechanics, Dec. 1944, p. 129, "Turn Button Prevents Raising of Sliding Bolt Lock."

Popular Science, Jun. 1959, p. 149, "Magnetic Lock Outwits Priers."

*Primary Examiner*—Kenneth J. Dorner

*Attorney, Agent, or Firm*—Carroll F. Palmer

[57] ABSTRACT

A doorway is protected against unauthorized entry by a sliding bolt that extends at an angle through a hole in the unhinged side of the door and the jamb and stud. A ring member fastened into the door retains the bolt in locking position and also provides hanging storage for the bolt when withdrawn. The door hinges have internal pegs that keep the door closed even if the exposed hinge pins are removed.

A template is provided for forming the angled hole in the door, jamb and stud.

2 Claims, 9 Drawing Figures

FIG 1
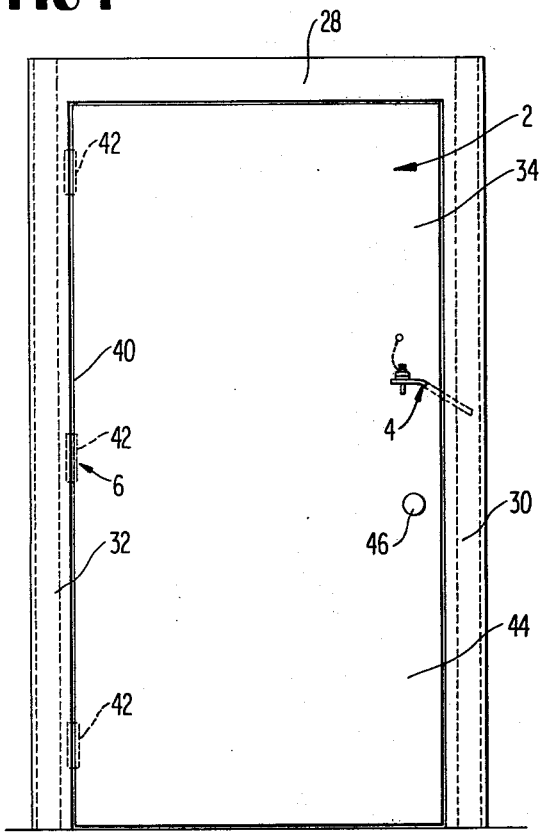
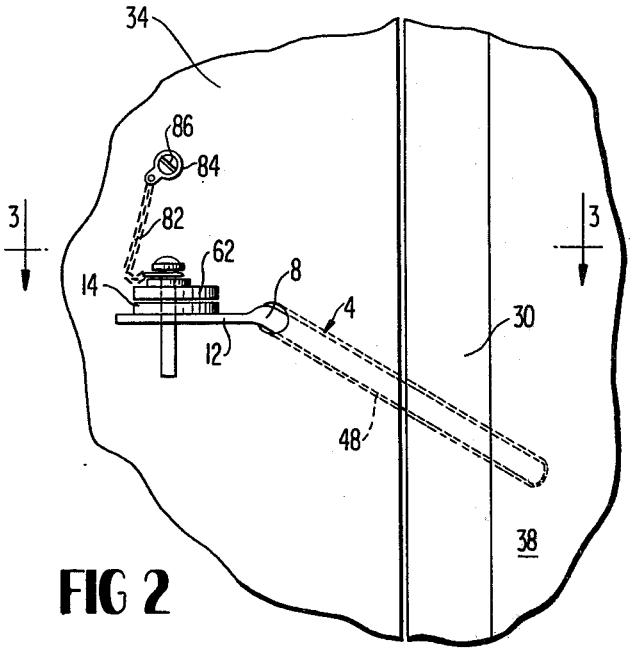
FIG 2
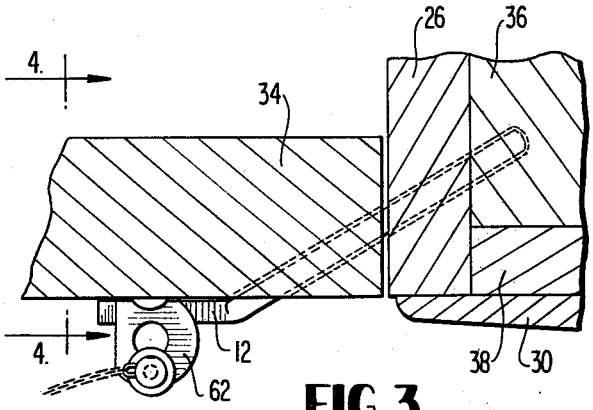
FIG 3
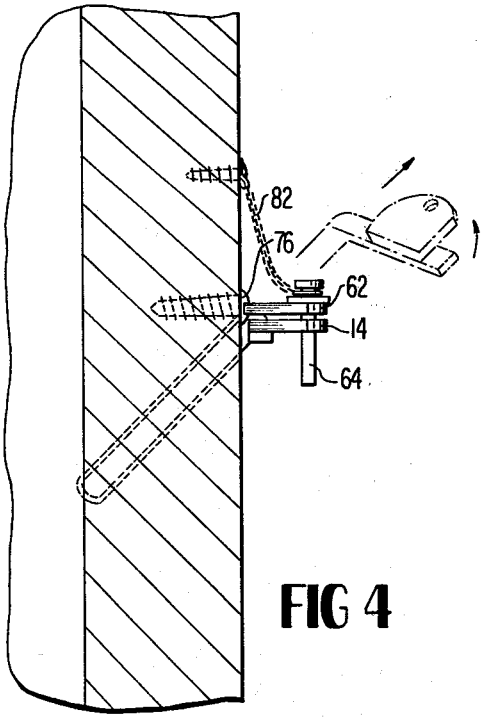
FIG 4
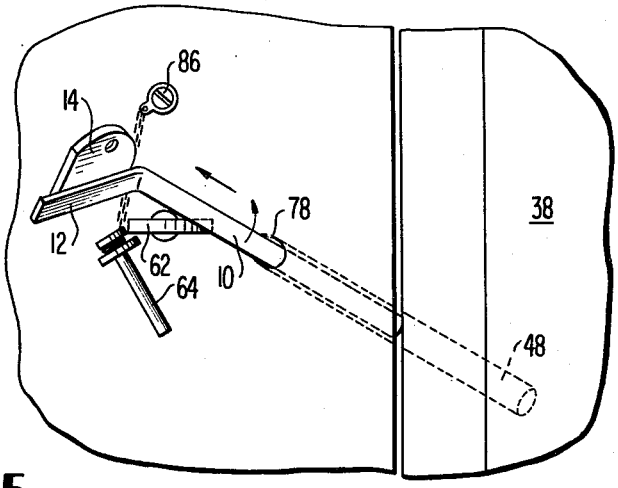
FIG 5

FIG 6
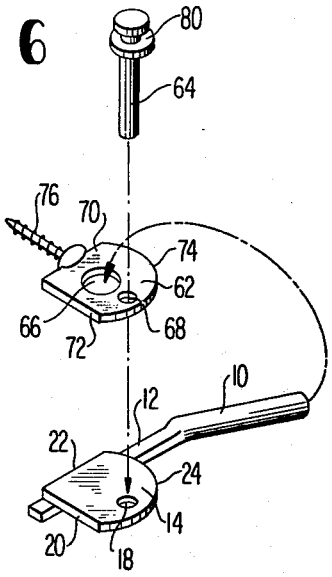
FIG 7
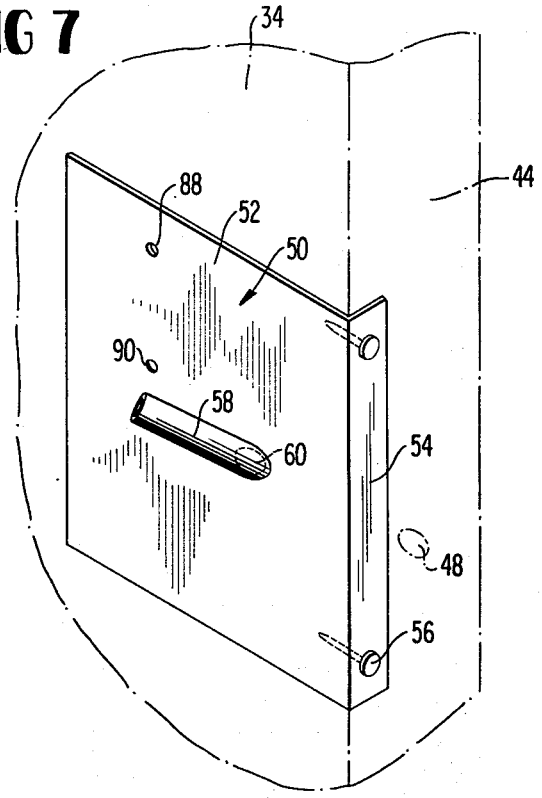
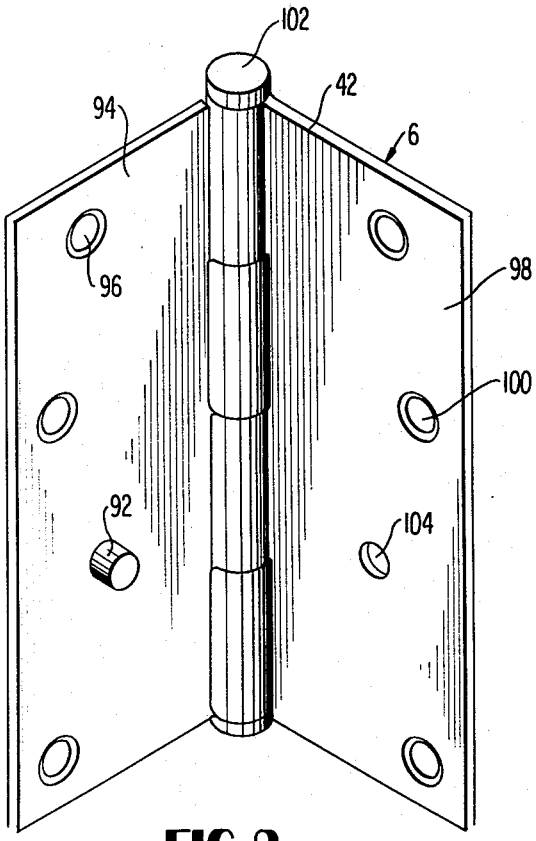
FIG 8
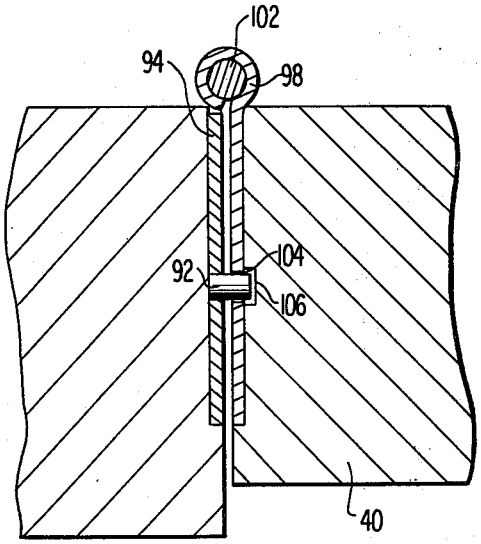
FIG 9

PROTECTIVE MEANS AGAINST UNAUTHORIZED ENTRY FOR A DOORWAY

CROSS-REFERENCE TO RELATED APPLICATION

This application is a continuation-in-part of Ser. No. 663,129, filed Mar. 2, 1976 which, in turn, is a division of my copending application Ser. No. 466,798 filed May 3, 1974 (now abandoned).

BACKGROUND OF THE INVENTION

1. Field of the Invention

This invention relates to dwelling security devices. More particularly, it concerns sliding bolt and related means to protect against unauthorized entry through a doorway.

2. Description of the Prior Art

A great variety of lock and bolt devices have been devised to keep doors closed against unauthorized entry. Many of these are so highly complex and expensive as to be impracticable for use generally with residential dwellings.

Sliding bolt devices that may be attached such as by fasteners to doors are known (see U.S. Pat. Nos. 708,892 and 1,485,301). However, the weakness in such units is the screw, staples or like attachment that permits the door to be forced open by simple application of pressure on the door. Some forms of sliding bolt devices use a hole in the adjacent building structure as retainer means for bolt (see U.S. Pat. No. 1,646,136).

Notwithstanding the high state of development of the art on door locks and bolts, there exists a need for a simple, inexpensive means that will require structural demolition, with resulting occupant and/or neighbor awareness, of building structure before unauthorized entry through the doorway of a dwelling can be attained by an intruder.

OBJECTS

A principal object of this invention is the provision of protective means against unauthorized entry for a doorway.

A further object is the provision of simple sliding bolt means that requires structural demolition of a doorway structure of a dwelling before unauthorized entry through the doorway can be attained by an intruder.

Another object is the provision of a doorway security system comprising a sliding bolt as aforesaid and door hinges that will maintain doorway security even if the hinge bolts were to be removed.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by providing a doorway with an angled sliding bolt member that extends at an angle, downwardly and inwardly, into a hole in the door, door frame and stud. The angle and position of the door jamb and stud hole is such that the bolt may be withdrawn when the bolt leg is in the up position; but the bolt may not be withdrawn when the bolt leg is in the down position.

The objects are further accomplished by providing doors equipped with sliding bolt members, as aforesaid, with door hinges that have internal pegs that prevent the hinge plates from being moved relative to one another, when the door is closed, even though the hinge pins have been removed.

The invention also provides a unique form of template for forming the angled hole in the door, jamb and stud into which the sliding bolt member extends.

BRIEF DESCRIPTION OF THE DRAWINGS

A more complete understanding of the invention may be had by reference to the accompanying drawings in which:

FIG. 1 is a lateral view of a doorway provided with protective means of the invention.

FIG. 2 is an enlarged, lateral, fragmentary view of a sliding bolt member of the invention.

FIG. 3 is a sectional view taken on the line 3—3 of FIG. 2.

FIG. 4 is a sectional view taken on line 4—4 of FIG. 3.

FIG. 5 is a fragmentary view similar to FIG. 2 shown in sliding bolt member partially withdrawn from its nest.

FIG. 6 is an isometric, exploded view of the components of the sliding bolt member of the invention.

FIG. 7 is an isometric view of a bolt-hole forming template of the invention.

FIG. 8 is an isometric view of special door hinges in accordance with the invention.

FIG. 9 is a longitudinal, fragmentary, sectional view of a hinge as in FIG. 8 installed in a door.

DESCRIPTION OF THE PREFERRED EMBODIMENTS

Referring in detail to the drawings, the protective means of the invention comprises, in combination with the doorway 2, sliding bolt means 4 and hinge means 6.

The bolt means 4 comprises a bolt 8 having a major longitudinal portion 10 and a minor angled leg portion 12. Annular member 14 bearing a lateral hole 18, straight edges 20 and 22 and acruate edge 24 is fixed, such as by brazing or welding, to the minor leg 12.

The sliding bolt means 4 protects the doorway 2 against unauthorized entry. The doorway 2 is defined by jamb 26, top frame member 28 and side frame members 30 and 32 surrounding the door 34. The jamb 26 is backed by the stud 36 and the wall 38. The door is hinged on its side 40 by hinge means 6 which comprises three identical hinges 42. The door 34 is provided on its unhinged side 44 with closure means 46, e.g., a doorknob, latch handle or the like.

A hole 48 is drilled in the door 34, the jamb 26 and extends into the stud 36 so that the hole is at least as long as the bolt major portion 10. The template 50 is advantageously used to obtain a correct drilling of the hole 48. The template 50 is formed of sheet metal with a main section 52 and a leg section 54 normal to section 52. A pair of holes are provided in section 54 through which tacks or brads 56 may extend to hold the template on the unhinged end 44 of the door 34. The tubular member 58 is fixed, such as by welding or brazing, to the section 52 over the hole 60 at the proper angle to guide a drill (not shown) to form the hole 48. The hole 48 is drilled slightly larger in diameter than the outside diameter of the bolt section 10.

The sliding bolt 8 is held in the locking position (see FIG. 2) by the annular member 62 and pin 64. The member 62 is formed with central hole 66, lateral hole 68, straight edges 70 and 72 and arcuate edge 74. A screw 76 is brazed or welded to member 62 permitting it to be fixed to the door (see FIG. 4) adjacent the proximal end 78 of the hole 48.

The pin 64 has a shoulder portion 80 to receive one end of the chain 82 whose other end 84 is fixed by screw 86 to the door 34. Holes 88 and 90 are provided in the template 50 to mark the location in the door 34 of the screws 84 and 76 respectively.

The locking position (see FIGS. 2–4) of the bolt 8 is arranged so that annular member 14 is jaxtaposed parallel to annular member 62 with the pin 64 extending through holes 68 and 18. To open the door, the pin 64 is removed from said holes and the bolt leg 12 and member 14 are swung downward and then around (see FIGS. 4 and 5) so that the bolt 8 can clear the member 62. When the bolt 8 is fully removed, it may be stored for ready locking use by dropping its portion 10 through the hole 66 in member 62 as illustrated by the dotted line on FIG. 6.

The complete protective means of the invention also includes the security hinge means 6 comprising hinge 42 and internal peg 92. The hinge 42 consists of first plate 94 having screw holes 96, second hinge plate 98 having screwholes 100 and a hinge pin 102. The internal peg 92, fixed on plate 94, cooperates with the hole 104 in plate 98. When the door is closed (see FIG. 9), the peg 92 enters the hole 104 and countersink 106 to prevent any sliding of the plate 94 relative to plate 98 even if hinge pin 102 were removed by an intended intruder. The peg 92, however, does not interfer with the free pivoting of the hinge plates 94 and 98 during the normal opening and closing of the door 34.

The embodiments of the invention in which an exclusive property or privilege is claimed are defined as follows:

1. Protective means against unauthorized entry for a doorway which comprises:

a sliding bolt having a major longitudinal body portion and a minor angled leg portion, a doorway defined in part by a jamb backed by a stud, a door having inner and outer faces hinged at one side closing said doorway, a hole drilled in said door, jamb and stud at an angle downard, said hole being at least as long as said bolt body portion and slighty larger in diameter than the diameter of said bolt, said bolt being inserted in said hole, a first annular member fastened to said inner face of said door normal thereto and adjacent said hole in the door, said annular member comprising a central hole large enough to receive the body portion of said bolt and a smaller lateral hole, a second annular member fixed upon said angled leg portion having a hole therein corresponding to said lateral hole of said first annular member whereby said second annular member may be juxtaposed parallel to said first annular member when said bolt is fully inserted in said door hole with said lateral hole and second annular member hole aligned, and a pin extending through said lateral hole and said second annular member hole.

2. The protective means of claim 1 comprising door hinges formed of first and second plates hinged together, an internal peg fixed upon the first plate and a mating hole in said second plate so that when the hinge is in a closed condition, the peg extends through said mating hole.

* * * * *